US008475294B2

(12) United States Patent
Sugawara et al.

(10) Patent No.: US 8,475,294 B2
(45) Date of Patent: Jul. 2, 2013

(54) GOLF CLUB HEAD, FACE OF THE GOLF CLUB HEAD, AND METHOD OF MANUFACTURING THE GOLF CLUB HEAD

(75) Inventors: Ryo Sugawara, Chiba (JP); Tomoo Kobayashi, Chiba (JP)

(73) Assignee: Seiko Instruments Inc. (JP)

( * ) Notice: Subject to any disclaimer, the term of this patent is extended or adjusted under 35 U.S.C. 154(b) by 702 days.

(21) Appl. No.: 12/583,269

(22) Filed: Aug. 18, 2009

(65) Prior Publication Data

US 2010/0048322 A1 Feb. 25, 2010

(30) Foreign Application Priority Data

Aug. 21, 2008 (JP) ..... 2008-212930

(51) Int. Cl.
*A63B 53/04* (2006.01)

(52) U.S. Cl.
USPC ..... 473/342; 473/349

(58) Field of Classification Search
USPC ..... 473/324–350; 148/121–675; 420/28–585
See application file for complete search history.

(56) References Cited

U.S. PATENT DOCUMENTS

| | | | | | |
|---|---|---|---|---|---|
| 3,582,320 | A | * | 6/1971 | Herchenroeder | 420/436 |
| 3,767,385 | A | * | 10/1973 | Slaney | 420/585 |
| 3,837,930 | A | * | 9/1974 | Cairns et al. | 419/13 |
| 3,871,927 | A | * | 3/1975 | Masumoto et al. | 148/121 |
| 4,059,462 | A | * | 11/1977 | Masumoto et al. | 148/306 |
| 4,082,579 | A | * | 4/1978 | Masumoto et al. | 148/306 |
| 4,147,538 | A | * | 4/1979 | Yajima et al. | 75/229 |
| 4,353,742 | A | * | 10/1982 | Crook | 420/585 |
| 4,445,943 | A | * | 5/1984 | Smith, Jr. et al. | 148/675 |
| 4,639,352 | A | * | 1/1987 | Kodama et al. | 419/15 |
| 4,710,345 | A | * | 12/1987 | Doi et al. | 419/28 |
| 4,765,956 | A | * | 8/1988 | Smith et al. | 420/445 |
| 4,768,787 | A | * | 9/1988 | Shira | 473/331 |
| 4,992,236 | A | * | 2/1991 | Shira | 419/28 |
| 5,998,048 | A | * | 12/1999 | Jin et al. | 428/836.3 |
| 6,059,670 | A | * | 5/2000 | Mogan | 473/342 |
| 6,099,414 | A | * | 8/2000 | Kusano et al. | 473/342 |
| 6,146,474 | A | * | 11/2000 | Coutu et al. | 148/315 |
| 6,406,382 | B1 | * | 6/2002 | Deshmukh et al. | 473/349 |
| 6,630,103 | B2 | * | 10/2003 | Martin et al. | 420/38 |
| 7,014,571 | B2 | * | 3/2006 | Deshmukh | 473/342 |
| 8,172,699 | B2 | * | 5/2012 | Nakamura | 473/330 |

FOREIGN PATENT DOCUMENTS

| | | | | |
|---|---|---|---|---|
| EP | 935008 | A1 | * | 8/1999 |
| JP | 60089548 | A | * | 5/1985 |
| JP | 61291934 | A | * | 12/1986 |
| JP | 2003147404 | A | * | 5/2003 |
| JP | 2004230046 | A | * | 8/2004 |

* cited by examiner

*Primary Examiner* — Alvin Hunter
(74) *Attorney, Agent, or Firm* — Adams & Wilks

(57) ABSTRACT

A golf club head that may increase the degree of freedom in design, a face of the golf club head, and a method of manufacturing the golf club head are provided. At least part of the golf club head includes an alloy, and the alloy includes Co and Fe in a total amount of 33 mass % to 65 mass %, Ni in an amount of 15 mass % to 35 mass %, Cr in an amount of 10 mass % to 25 mass %, Mo in an amount of 3 mass % to 12 mass %, at least one of Nb in an amount of 2 mass % or less and W in an amount of 5 mass % or less, and at least one of Mn in an amount of 2 mass % or less and Ti in an amount of 1 mass % or less.

8 Claims, 2 Drawing Sheets

FIG. 3

| | Example 1 | Example 2 | Example 3 | Example 4 | Comparative example 1 SUS304 | Comparative example 2 SUS316 | Comparative example 3 SUS630 | Comparative example 4 hastelloy C22 | Comparative example 5 hastelloy C276 | Comparative example 6 carbon steel S10C |
|---|---|---|---|---|---|---|---|---|---|---|
| Co (mass %) | 39 | | 36 | | 0 | 0 | 0 | 0 | 1 | 0 |
| Fe (mass %) | 23 | | 2 | | 72 | 67.5 | 75.5 | 4 | 6 | 99.5 |
| Ni (mass %) | 17 | | 31 | | 8.5 | 12 | 5 | 56.5 | 57 | 0 |
| Cr (mass %) | 12 | | 19 | | 18 | 17 | 15.5 | 22 | 16 | 0 |
| Mo (mass %) | 4 | | 10 | | 0 | 2 | 0 | 13 | 16.5 | 0 |
| Nb (mass %) | 0 | | 1 | | 0 | 0 | 0.5 | 0 | 0 | 0 |
| W (mass %) | 4 | | 0 | | 0 | 0 | 0 | 4 | 3 | 0 |
| Mn (mass %) | 0.5 | | 0.5 | | 1.5 | 1.5 | 0.5 | 0.5 | 0.5 | 0.5 |
| Ti (mass %) | 0.5 | | 0.5 | | 0 | 0 | 0 | 0 | 0 | 0 |
| Others | - | | - | | - | - | 3Cu | - | - | - |
| Cold working and heat treatment | not performed | performed | not performed | performed | not performed | not performed | not performed | not performed | not performed | not performed |
| Longitudinal elastic modulus (GPa) | 215 | 215 | 225 | 225 | 193 | 193 | 205 | 206 | 206 | 196 |
| Thickness (mm) | 2 | 2 | 1.9 | 1.9 | 2.5 | 2.5 | 2.5 | 2.5 | 2.5 | 2.5 |
| Flying distance (yard) | 175 | 177 | 176 | 180 | 170 | 169 | 172 | 172 | 173 | 170 |
| Corrosion resistance | good | good | excellent | excellent | bad | somewhat bad | bad | excellent | excellent | bad |
| Abrasion loss | excellent | excellent | good | good | good | good | good | somewhat bad | somewhat bad | good |

GOLF CLUB HEAD, FACE OF THE GOLF CLUB HEAD, AND METHOD OF MANUFACTURING THE GOLF CLUB HEAD

BACKGROUND OF THE INVENTION

1. Field of the Invention

The present invention relates to a golf club head, a face of the golf club head, and a method of manufacturing the golf club head.

2. Description of the Related Art

Recently, various golf club head designs have been made within the standards established for golf clubs in order to increase a flying distance, and to improve durability of the head. For example, a golf club described in Japanese Patent No. 3999493 is increased in moment of inertia by lowering the center of gravity, and has an undercut portion in a sole to stabilize a flying distance.

A golf club described in JP-A-2004-187710 has a thin portion and a thick portion in a face for hitting a ball. In the golf club, the thin portion is used to control amount of deflection of the face in ball-hitting, and the thick portion is used to increase strength of a head.

SUMMARY OF THE INVENTION

Generally, when the face of the golf club has an extremely large thickness, weight of the face increases, and thereby the center of gravity of the head as a whole moves to a face side, leading to a problem of decrease in depth of the center of gravity. On the other hand, when the face of the golf club has an extremely small thickness, strength of the face decreases. Therefore, thickness of the face is set within a range where certain strength may be kept. However, most of the faces have been formed of carbon steel or stainless steel in the past, and therefore the degree of freedom in design has been limited in strength of such material.

The invention was made in the light of the above problem, and an object of the invention is to provide a golf club head that may increase the degree of freedom in design, a face of the golf club head, and a method of manufacturing the golf club head.

To solve the above problem, the invention includes a golf club head, wherein at least part of the golf club head includes an alloy, and the alloy includes Co and Fe in a total amount of 33 mass % to 65 mass %, Ni in an amount of 15 mass % to 35 mass %, Cr in an amount of 10 mass % to 25 mass %, Mo in an amount of 3 mass % to 12 mass %, at least one of Nb in an amount of 2 mass % or less and W in an amount of 5 mass % or less, and at least one of Mn in an amount of 2 mass % or less and Ti in an amount of 1 mass % or less.

According to such a configuration, the alloy having the above composition is used for a golf club head, increasing Young's modulus of the head. Therefore, mechanical strength of the head may be improved without increasing thickness of the head. Consequently, the degree of freedom in design of a golf club may be improved.

In the golf club head, the alloy includes Co and Fe in a total amount of 33 mass % to 38 mass %, Ni in an amount of 29 mass % to 35 mass %, Cr in an amount of 18 mass % to 25 mass %, Mo in an amount of 8 mass % to 12 mass %, at least one of Nb in an amount of 2 mass % or less and W in an amount of 5 mass % or less, and at least one of Mn in an amount of 2 mass % or less and Ti in an amount of 1 mass % or less.

According to such a configuration, the alloy having the above composition is used for a golf club head, increasing Young's modulus of the head. Therefore, mechanical strength of the head may be improved without increasing thickness of the head. Consequently, the degree of freedom in design of a golf club may be improved.

The invention includes a face of a golf club head, wherein the face includes an alloy, and the alloy includes Co and Fe in a total amount of 33 mass % to 65 mass %, Ni in an amount of 15 mass % to 35 mass %, Cr in an amount of 10 mass % to 25 mass %, Mo in an amount of 3 mass % to 12 mass %, at least one of Nb in an amount of 2 mass % or less and W in an amount of 5 mass % or less, and at least one of Mn in an amount of 2 mass % or less and Ti in an amount of 1 mass % or less.

According to the above invention, the alloy having the above composition is used for a face of a golf club head, increasing Young's modulus of the head. Therefore, mechanical strength of the head may be improved without increasing thickness of the head. Consequently, the degree of freedom in design of a golf club may be improved.

The invention includes a method of manufacturing a golf club head, wherein an alloy is cold-worked at a reduction ratio of 25% or more so that the alloy is formed into a golf club head. The alloy includes Co and Fe in a total amount of 33 mass % to 65 mass %, Ni in an amount of 15 mass % to 35 mass %, Cr in an amount of 10 mass % to 25 mass %, Mo in an amount of 3 mass % to 12 mass %, at least one of Nb in an amount of 2 mass % or less and W in an amount of 5 mass % or less, and at least one of Mn in an amount of 2 mass % or less and Ti in an amount of 1 mass % or less.

According to the method, the alloy having the above composition is used for a golf club head, thereby a golf club head having high Young's modulus and high mechanical strength may be produced without increasing thickness of the golf club head. In addition, the alloy is cold-worked at a reduction ratio of 25% or more, which may further increase Young's modulus and mechanical strength of the head. Consequently, the degree of freedom in design of a golf club may be improved.

In the method of manufacturing a golf club head, the cold-worked alloy is subjected to heat treatment at 300° C. or more.

According to the method, the alloy is subjected to heat treatment at 300° C. or more, which may further increase mechanical strength of the golf club head.

In the method of manufacturing a golf club head, the alloy is subjected to the heat treatment in a vacuum or in an anti-oxidation atmosphere.

According to the method, since the alloy is subjected to heat treatment in a vacuum or in an anti-oxidation atmosphere, coloration or discoloration of the golf club head may be prevented in addition to increase in mechanical strength of the head.

BRIEF DESCRIPTION OF THE DRAWINGS

FIG. 3 is a table showing examples and comparative examples.

DESCRIPTION OF THE PREFERRED EMBODIMENT

Figure 1:
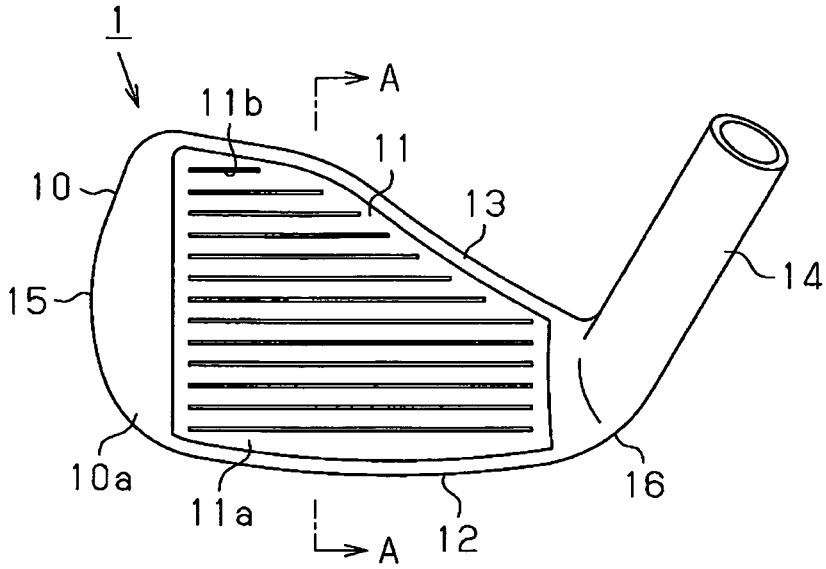
FIG. 1 is a front view of a golf club head.

Hereinafter, an embodiment, which embodies the invention, will be described according to FIGS. 1 to 3. FIG. 1 is a schematic view of a golf club head as viewed from the front of the head, and FIG. 2 is a section view of the golf club head along a line A-A in FIG. 1.

As shown in FIG. 1, a golf club head 1 has a body 10 and a ball-striking face 11 fixed to the body 10. The body 10 is formed of stainless steel, and includes a sole 12 being contacted to the ground in ball-hitting, a head 13, a hosel 14 connected to a shaft, a toe 15, and a heel 16.

Figure 2:
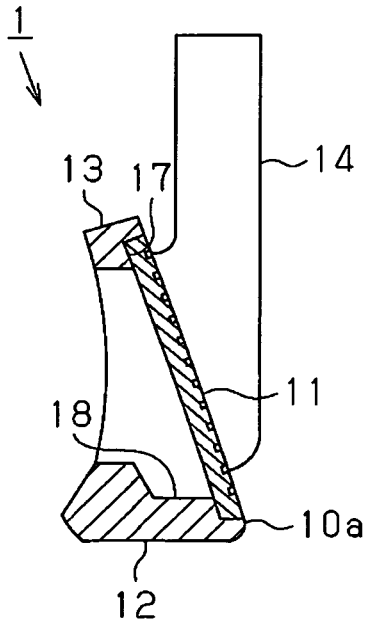
FIG. 2 is a section view of the golf club head.

As shown in FIG. 2, an attachment frame 17 for fitting the face 11 therein is formed in a front face 10a of the body 10. The face 11 is in the form of an insert that is attached to the body 10 by means of welding, press fitting, screwing, caulking or the like.

A cavity 18 extending from the toe 15 to the heel 16 is formed in an upper part of the sole 12. The cavity 18 permits the face 11 to easily deflect to a back side in ball-hitting, leading to increase in repellency of the face 11. Zone Name: A5,AMD The face 11 includes a Co-base alloy, and is formed into a sheet shape. Since the Co-base alloy has high durability, the face 11 is not subjected to plating or coating. A face surface (front face) 11*a* has groove-like score lines 11*b* engraved thereon. The score lines 11*b* enhance the frictional force between the face surface 11*a* and a ball, and are horizontally formed at even intervals from the toe 15 to the heel 16 in order to increase backspin. When an edge of each score line 11*b* is rounded, the frictional force applied to a ball is reduced, leading to decrease in spin. However, since the face 11 is not subjected to plating, an edge of the groove may be sharpened, leading to increase in spin.

Next, a composition of the Co-base alloy is described. The Co-base alloy includes Co and Fe in a total amount of 33 mass % to 65 mass %, Ni in an amount of 15 mass % to 35 mass %, Cr in an amount of 10 mass % to 25 mass %, Mo in an amount of 3 mass % to 12 mass %, at least one of Nb in an amount of 2 mass % or less and W in an amount of 5 mass % or less, at least one of Mn in an amount of 2 mass % or less and Ti in an amount of 1 mass % or less, and inevitable impurities. Hereinafter, the above composition is called first composition. The alloy may be increased in Young's modulus and mechanical strength by the composition.

Co (cobalt) reinforces a matrix of the alloy, reduces notch brittleness, and increases fatigue strength. Ni makes the alloy to be austenitic, in addition, increases Young's modulus of the alloy, and improves a work hardening property thereof. Since Co is expensive, Fe is partially substituted for Co, thereby cost may be reduced while well keeping the above performance. A blending ratio of Fe is less than 50% of total mass of Co and Fe. When the blending ratio of Fe is 50% or more of the total mass of Co and Fe, high Young's modulus may not be kept, and consequently high mechanical strength may not be maintained. When the total content of Co and Fe is less than 33 mass % of total mass of the alloy, the described effects are not sufficiently exhibited. When the total content of Co and Fe is more than 65 mass % of the total mass, the matrix of the alloy is too hardened, so that the alloy is hard to be formed into a member configuring a golf club head.

Ni forms stable austenite, and thus improves toughness of the alloy. Moreover, Ni has an effect of keeping certain workability when the alloy is formed into the member configuring a golf club head, and an effect of improving corrosion resistance. When the blending ratio of Ni is less than 15 mass %, the effects are not sufficiently exhibited, and when it is more than 35 mass %, Young's modulus and mechanical strength are reduced.

Cr (chromium) improves corrosion resistance of the face 11, and increases mechanical strength thereof. When the blending ratio of Cr is more than 25 mass % of the total mass, workability is reduced.

Mo (molybdenum) has an effect of improving corrosion resistance of the alloy, and an effect of increasing mechanical strength thereof. Particularly, Mo improves corrosion resistance against a halogenic solution or a halogenic gas. However, if a ratio of Mo in the alloy is high, the alloy is extremely hardened, leading to significant reduction in workability. When the blending ratio of Mo is less than 3 mass %, the effects are not sufficiently provided, and when it is more than 12 mass %, a phase is precipitated, causing embrittlement of the alloy.

Since Nb (niobium) and W (tungsten) provide approximately the same effect, at least one of them is added. Nb forms an intermetallic compound with Ni, and causes significant hardening of the alloy due to fine plate-like precipitation. However, when Nb is excessive, ductility of the alloy is lost, so that plastic working of the alloy becomes difficult. The blending ratio of Nb is set to 2 mass % or less of the total mass, thereby a preferable property is obtained.

W produces carbide, and increases mechanical strength by precipitation hardening. When the blending ratio of W is more than 5 mass %, ductility of the alloy is lost, so that plastic working of the alloy becomes difficult.

Since Mn (manganese) and Ti (titanium) provide approximately the same effect, at least one of them is added. Mn acts as a deoxidizer or a desulfurizing agent, in addition, has an effect of stabilizing austenite. When the content of Mn is more than 2 mass % of the total mass, corrosion resistance of the alloy is reduced.

Ti has a function of strong deoxidization or denitrification, and has an effect of refining an ingot structure, which contributes to increasing strength of the alloy. Ti is blended in an amount of 1 mass % or less depending on oxygen amount or nitrogen amount of other materials. When the blending ratio of Ti is more than 1 mass %, a compound of Ti is produced, which reduces toughness of the alloy.

When the Co-base alloy has a composition of Co and Fe in a total amount of 33 mass % to 38 mass %, Ni in an amount of 29 mass % to 35 mass %, Cr in an amount of 18 mass % to 25 mass %, Mo in an amount of 8 mass % to 12 mass %, at least one of Nb in an amount of 2 mass % or less and W in an amount of 5 mass % or less, and at least one of Mn in an amount of 2 mass % or less and Ti in an amount of 1 mass % or less, the alloy may be increased in Young's modulus, and improved in corrosion resistance compared with the alloy having the first composition. The alloy having the first composition has high abrasion resistance compared with the alloy having the above composition. Hereinafter, the above composition is called second composition.

The alloy is hot-forged, and rolled into a strip. The rolling step may be changed to forging. Thickness of the strip is preferably 1.0 mm to 5.0 mm. When the thickness is less than 1.0 mm, the strip may not have sufficient mechanical strength, which unfavorably reduces resistance to external force caused by ball-hitting or the like. When the thickness is more than 5.0 mm, depth of the center of gravity is reduced due to increase in weight, and preferable repellency within the golf club standards is not obtained.

The strip is subjected to cold working at a reduction ratio of more than 25%. The cold working causes formation of a deformed crystal and refinement of a structure, leading to significant work hardening. When the cold working ratio is more than 25%, deformation twining begins to appear, causing significant work hardening. The alloy may have sufficiently high Young's modulus and strength as it is cold-worked. However, the alloy is further subjected to heat treatment at 300° C. or more, thereby mechanical strength of the alloy may be more increased. When aging treatment is performed in a vacuum or an anti-oxidation atmosphere as the heat treatment, high strength is obtained, and coloring of the strip or the like may be prevented.

A longitudinal elastic modulus (GPa) of the strip is preferably 210 GPa to 300 GPa. When the modulus is less than 210 GPa, high resistance to external force caused by ball-hitting or the like is not obtained. When the modulus is more than 300 GPa, workability is reduced.

In this way, the material of the face 11 is changed from a previous material to an alloy having high Young's modulus. Thus, for example, even if the face 11 is decreased in thickness, high mechanical strength may be maintained. Therefore, a restriction of thickness due to material is relaxed, and thereby the degree of freedom in design, including design for increasing a flying distance, may be increased.

The strip is subjected to punching in accordance with a shape of the face 11, and score lines 11*b* are formed on one side face by pressing. Since the face 11 produced in this way has high durability including corrosion resistance and abrasion resistance, the face need not be subjected to plating or coating. This may prevent reduction in frictional force on the face surface 11*a* due to plating or the like. In addition, labor and cost taken for plating or the like may be reduced.

Next, advantages of the invention are verified through carrying out examples and comparative examples, in which alloy compositions are made different from one another.

EXAMPLE 1

The alloy having the first composition was used to produce a strip 2 mm in thickness by hot forging and rolling, and a face 11 was produced using the strip. Cold working and heat treatment were not performed.

EXAMPLE 2

The alloy having the first composition was used to produce a strip 2 mm in thickness by hot forging and rolling. Furthermore, the strip was subjected to cold working at a reduction ratio of 30%, and then subjected to aging treatment at 400° C. in a vacuum. Then, the strip was formed into a face 11.

EXAMPLE 3

The alloy having the second composition was used to produce a strip 1.9 mm in thickness by hot forging and rolling, and a face 11 was produced using the strip. Cold working and heat treatment were not performed.

EXAMPLE 4

The alloy having the second composition was used to produce a strip 1.9 mm in thickness by hot forging and rolling. Furthermore, the strip was subjected to cold working at a reduction ratio of 30%, and then subjected to aging treatment at 400° C. in a vacuum. Then, the strip was formed into a face 11.

COMPARATIVE EXAMPLE 1

A face 11 was produced in the same way as in the example 1 by using SUS304 in place of the alloy having the first composition. The face 11 was formed to be 2.5 mm in thickness in consideration of strength of the material.

COMPARATIVE EXAMPLE 2

A face 11 was produced in the same way as in the example 1 by using SUS316 in place of the alloy having the first composition. The face 11 was formed to be 2.5 mm in thickness in consideration of strength of the material.

COMPARATIVE EXAMPLE 3

A face 11 was produced in the same way as in the example 1 by using SUS630 in place of the alloy having the first composition. The face 11 was formed to be 2.5 mm in thickness in consideration of strength of the material.

COMPARATIVE EXAMPLE 4

A face 11 was produced in the same way as in the example 1 by using Hastelloy C22 (registered trademark) in place of the alloy having the first composition. The face 11 was formed to be 2.5 mm in thickness in consideration of strength of the material.

COMPARATIVE EXAMPLE 5

A face 11 was produced in the same way as in the example 1 by using Hastelloy C276 (registered trademark) in place of the alloy having the first composition. The face 11 was formed to be 2.5 mm in thickness in consideration of strength of the material.

COMPARATIVE EXAMPLE 6

A face 11 was produced in the same way as in the example 1 by using carbon steel S10C in place of the alloy having the first composition. The face 11 was formed to be 2.5 mm in thickness in consideration of strength of the material.

As shown in a table of FIG. 3, a larger longitudinal elastic modulus (Young's modulus) was obtained in each of the examples 1 to 4 compared with that in each of the comparative examples 1 to 6.

Verification

The following verification was performed using the faces 11 or the strips in the examples 1 to 4 and the comparative examples 1 to 6.

Verification 1

The faces 11 in the examples 1 to 4 and the comparative examples 1 to 6 were used to produce iron golf clubs having a loft angle of 28 degrees and a club length of 37.5 inches respectively. The golf clubs were used to hit a commercial 2-piece ball at a head speed of 44 m/sec, and flying distances at that time were measured respectively. The flying distance was defined as a total range combining carry and run. A result of such measurement is shown in the table of FIG. 3.

As a result, the flying distance was long in each of the examples 1 to 4 compared with in each of the comparative examples 1 to 6. Particularly, the flying distance was considerably long in the example 2 or 4.

Verification 2

The strips having the compositions in the examples 1 to 4 and the comparative examples 1 to 6 were subjected to surface polishing by a sandpaper of grain size No. 1000 so that specimens were produced respectively. The specimens were immersed in 10% hydrochloric acid at 60° C., and corrosion conditions after 8 hours of the specimens were observed. A result of such observation is shown in the table of FIG. 3. In the table, a condition where no change occurs is shown as "excellent", a condition where only discoloration occurs is shown as "good", a condition where corrosion such as pitting is observed is shown as "somewhat bad", and a condition where a specimen partially falls off, and significant corrosion occurs is shown as "bad".

As a result, high corrosion resistance was obtained in each of the examples 1 to 4. Particularly, extremely high corrosion resistance was obtained in the example 3 or 4.

Verification 3

The strips having the respective compositions in the examples 1 to 4 and the comparative examples 1 to 6 were subjected to an abrasion test using a ball-on-disk tester. First, a disk-like test piece was produced from each strip, and a ball 6 mm in diameter including SUJ2 was prepared as a counter member for pressing a top of the test piece. Then, the ball was rotated on the test piece with rotation radius of the ball of 8 mm, a load of 5.0 N, rotational speed of 5 cm/sec, and an abrasion distance of 500 m. After the test, an abrasion mark on each test piece was observed. A result of such observation is shown in the table of FIG. 3. In the table, a condition where substantially no abrasion is found is shown as "excellent", a condition where while some abrasion is found, each abrasion mark is not deep is shown as "good", and a condition where each abrasion mark is deep, and abrasion is clearly found is shown as "somewhat bad".

As a result, high abrasion resistance was obtained in each of the examples 1 to 4. Particularly, extremely high abrasion resistance was obtained in the example 1 or 2.

That is, it is suggested that a golf club head 1 using the face in each of the examples 1 to 4 may combine a long flying distance and high durability.

According to the embodiment, the following advantages may be obtained.

(1) In the embodiment, a composition of the Co-base alloy used for the face 11 was specified as the first or second composition. Therefore, since an alloy having high Young's modulus and high durability is obtained, mechanical strength of the alloy may be improved without increasing thickness of the face 11. Therefore, the degree of freedom in design of a golf club, for example, design of decreasing thickness of the face 11, may be improved while keeping resistance to external force. Moreover, since durability such as corrosion resistance and abrasion resistance may be improved, surface treatment such as plating or coating may be eliminated. Therefore, an edge of each score line 11*b* formed on the face 11 is prevented from being rounded by surface treatment, and consequently frictional force on the face surface 11*a* in ball-hitting may be increased.

(2) In the embodiment, when the face 11 was produced, the strip was cold-worked at a reduction ratio of 25% or more. Therefore, Young's modulus and mechanical strength may be more improved by work hardening.

(3) In the embodiment, when the face 11 was produced, the strip was subjected to aging treatment at 300° C. or more in a vacuum or an anti-oxidation atmosphere. Therefore, mechanical strength may be more improved.

The embodiment may be modified in the following way.

A configuration of the golf club head 1 is not limited to the described or shown configuration, and may be appropriately modified or altered.

While the alloy having each of the compositions was used for the face 11 in the embodiment, the alloy may be used for a portion other than the face 11, or for a head as a whole. For example, even if the alloy is used for a portion of the golf club head 1, the portion being not contacted to a ball in ball-hitting, the advantages may be obtained, that is, durability of the portion is improved, and plating need not be performed.

While the face 11 was used for an iron club in the embodiment, the face may be used for a wood club.

What is claimed is:

1. A golf club head, at least a part of which is comprised of an alloy that includes Co and Fe in a total amount of 33 mass % to 65 mass % with the blending ratio of Fe being less than 50% of the total mass of Co and Fe, Ni in an amount of 15 mass % to 35 mass %, Cr in an amount of 10 mass % to 25 mass %, Mo in an amount of 3 mass % to 12 mass %, at least one of Nb in an amount of 2 mass % or less and W in an amount of 5 mass % or less, and at least one of Mn in an amount of 2 mass% or less and Ti in an amount of 1 mass % or less.

2. A golf club head according to claim 1; wherein the alloy includes

Co and Fe in a total amount of 33 mass % to 38 mass %, Ni in an amount of 29 mass % to 35 mass %, Cr in an amount of 18 mass % to 25 mass %, Mo in an amount of 8 mass % to 12 mass %, at least one of Nb in an amount of 2 mass % or less and W in an amount of 5 mass % or less, and at least one of Mn in an amount of 2 mass % or less and Ti in an amount of 1 mass % or less.

3. A golf head according to claim 2; wherein the part comprised of the alloy is a ball-striking face of the golf club head.

4. A golf club head according to claim 2; wherein the whole golf club head consists of the alloy.

5. A golf club head according to claim 2; wherein the part comprised of the alloy is a face insert attached to a body of the golf club head and which defines a ball-striking face of the golf club head.

6. A golf club head according to claim 1; wherein the part comprised of the alloy is a ball-striking face of the golf club head.

7. A golf club head according to claim 1; wherein the whole golf club head consists of the alloy.

8. A golf club head according to claim 1; wherein the part comprised of the alloy is a face insert attached to a body of the golf club head and which defines a ball-striking face of the golf club head.

* * * * *